US005997064A

United States Patent [19]

Orita

[11] Patent Number: 5,997,064

[45] Date of Patent: Dec. 7, 1999

[54] ARTICLE GRIPPING APPARATUS

[75] Inventor: Masamitsu Orita, Saitama-ken, Japan

[73] Assignee: Tsubakimoto Chain Co., Japan

[21] Appl. No.: 08/984,346

[22] Filed: Dec. 3, 1997

[30] Foreign Application Priority Data

Dec. 6, 1996 [JP] Japan ..... 8-327056

[51] Int. Cl.[6] ..... B66C 1/42

[52] U.S. Cl. ..... 294/119.1; 294/88; 294/81.62; 294/87.1; 294/907

[58] Field of Search ..... 294/88, 119.1, 294/907, 901, 902, 87.1, 81.62, 81.54; 901/46, 37, 22, 34, 33

[56] References Cited

U.S. PATENT DOCUMENTS

| | | | |
|---|---|---|---|
| 4,533,167 | 8/1985 | Johnson | 901/32 |
| 4,579,380 | 4/1986 | Zaremsky et al. | 901/46 |
| 4,591,198 | 5/1986 | Monforte | 294/902 |
| 5,100,285 | 3/1992 | Wagner | 901/32 |

FOREIGN PATENT DOCUMENTS

| | | | |
|---|---|---|---|
| 3038234 | 5/1982 | Germany | 294/902 |
| 3327060 | 2/1985 | Germany | 294/902 |
| 622705 | 6/1994 | Japan . | |
| 770788 | 10/1980 | U.S.S.R. | 901/37 |
| 918086 | 4/1982 | U.S.S.R. | 294/907 |
| 1093545 | 5/1984 | U.S.S.R. | 294/907 |
| 1110627 | 8/1984 | U.S.S.R. | 294/88 |
| 1405981 | 6/1988 | U.S.S.R. | 294/902 |

*Primary Examiner*—Dean J. Kramer
*Assistant Examiner*—Paul Chin
*Attorney, Agent, or Firm*—Woodling, Krost and Rust

[57] ABSTRACT

An article gripping apparatus capable of gripping the articles with adequate gripping pressure without damaging or dropping the gripped articles is disclosed.

The apparatus comprises paired clamp arms 7 opposedly arranged free to open and close; a plurality of opening- and closing driving means 10 for individually opening- and closing moving the clamp arms; a hydraulic jack 13 provided on each clamp arm and having a plunger 14, the plunger being prevented from backward movement by liquid sealed therein; clamp bodies 12 provided at the extreme end of the plunger; and pressure detection means 21 for individually detecting liquid pressure in the hydraulic jack, wherein when the pressure detection means detects the rise of liquid pressure in the hydraulic jack in excess of a predetermined pressure when the article is gripped between the pair of clamp bodies, the opening- and closing driving means for the clamp arms is stopped.

3 Claims, 6 Drawing Sheets

ARTICLE GRIPPING APPARATUS

INDUSTRIAL FIELD

The present invention relates to an article gripping apparatus used for an article transfer apparatus or the like.

PRIOR ART

In the past, for an article transfer apparatus used when winding sheets for newspaper sheets supplied to a rotary press are unloaded onto a paper storage yard, a gripping apparatus as disclosed, for example, in Japanese Utility Model publication No. 22705/1994 Publication, of the construction in which articles such as winding sheets are sandwiched and gripped from both sides by a pair of clamp arms opposedly open- and closed and driven.

The gripping apparatus described in the above publication is composed of three sets of paired clamp arms D provided on an elevating frame C driven to be moved up and down by an elevating driving means B from a travel frame A driven to be travelled along a ceiling of a building, as shown in FIG. 6.

In the aforementioned gripping apparatus, both ends of winding sheets F placed on a pallet of a truck E can be raised by gripping them by the pair of clamp arms D to transfer three winding sheets on the maximum once onto a sheet removing floor G of the sheet storage yard.

PROBLEM TO BE SOLVED BY THE INVENTION

In the arrangement described in the aforementioned Japanese Utility Model Publication No. 22705/1994 Publication, the pair of clamp arms for gripping both ends of the winding sheet are driven by a hydraulic cylinder driven by oil supplied from a common oil pressure supply source so as to grip the winding sheet. However, the adjustment of oil pressure applied to the hydraulic cylinder when the gripping operation takes place is carried out in advance on the supply source thereof. Therefore, when the gripping pressure of the clamp arms with respect to the winding sheet becomes excessive high or low for some cause, it is impossible to cope therewith, and when operation continues, the winding sheet tends to be damaged or to be fallen from the clamp arms.

The present invention overcomes the problem as noted above with respect to prior art. It is an object of the invention to provide an article gripping apparatus capable of positively gripping the articles with adequate gripping pressure without possibly damaging or dropping the gripped articles.

MEANS FOR SOLVING THE PROBLEM

For achieving the aforesaid object, according to the present invention, there is provided an article gripping apparatus comprising: a plurality of opening and closing driving means for individually opening and closing moving clamp arms; a hydraulic jack provided on each clamp arm and having a plunger projected on the opposite side, said plunger being prevented from backward movement by liquid sealed therein; a pair of clamp bodies provided at the extreme end of the plunger of each hydraulic jack to grip an article from both sides; and a plurality of pressure detection means for individually outputting a detection signal when the liquid pressure in the hydraulic jack rises to a level in excess of a predetermined pressure, wherein the opening and closing driving means is constituted such that the movement of the clamp arm is stopped by the detection signal output by the pressure detection means provided on the corresponding clamp arm, when the article is gripped between the pair of clamp bodies.

Preferably, the pressure detection means further outputs an abnormal detection signal in the case where the pressure in the hydraulic jack is outside the predetermined range in the state in which the article is gripped between the opposed clamp bodies of the pair of clamps.

FUNCTION

In the article gripping apparatus according to the present invention, the pair of clamp arms are driven in an access direction by the opening and closing driving means to sandwich and grip the article between the clamp bodies provided on the clamp arm through the hydraulic jack.

When the liquid pressure in the hydraulic jack exceeds above a predetermined pressure due to the reaction from the article acting on the clamp body, it is detected by the pressure detection means to control the opening and closing driving means so as to stop the drive of the clamp arm provided on the hydraulic jack.

Further, in the case of the constitution wherein the pressure detection means outputs an abnormal detection signal in the case where the pressure in the hydraulic jack is outside the predetermined range in the state in which the article is gripped between the opposed clamp bodies of the pair of clamps, when the gripping pressure of the clamp body exceeds a proper range of the gripping pressure or lowers on the conversely for some cause, the pressure detection means detects that the pressure in the hydraulic jack to which the clamp body is connected is outside of the range of pressure allowed to output an abnormal detection signal.

By the abnormal detection signal, it is possible to generate an alarm to notify the abnormal condition to an operator or stop the operation of the entire apparatus to prevent the article gripped from being damaged or fallen.

DESCRIPTION OF THE REFERENCE NUMERALS

Figure 1:
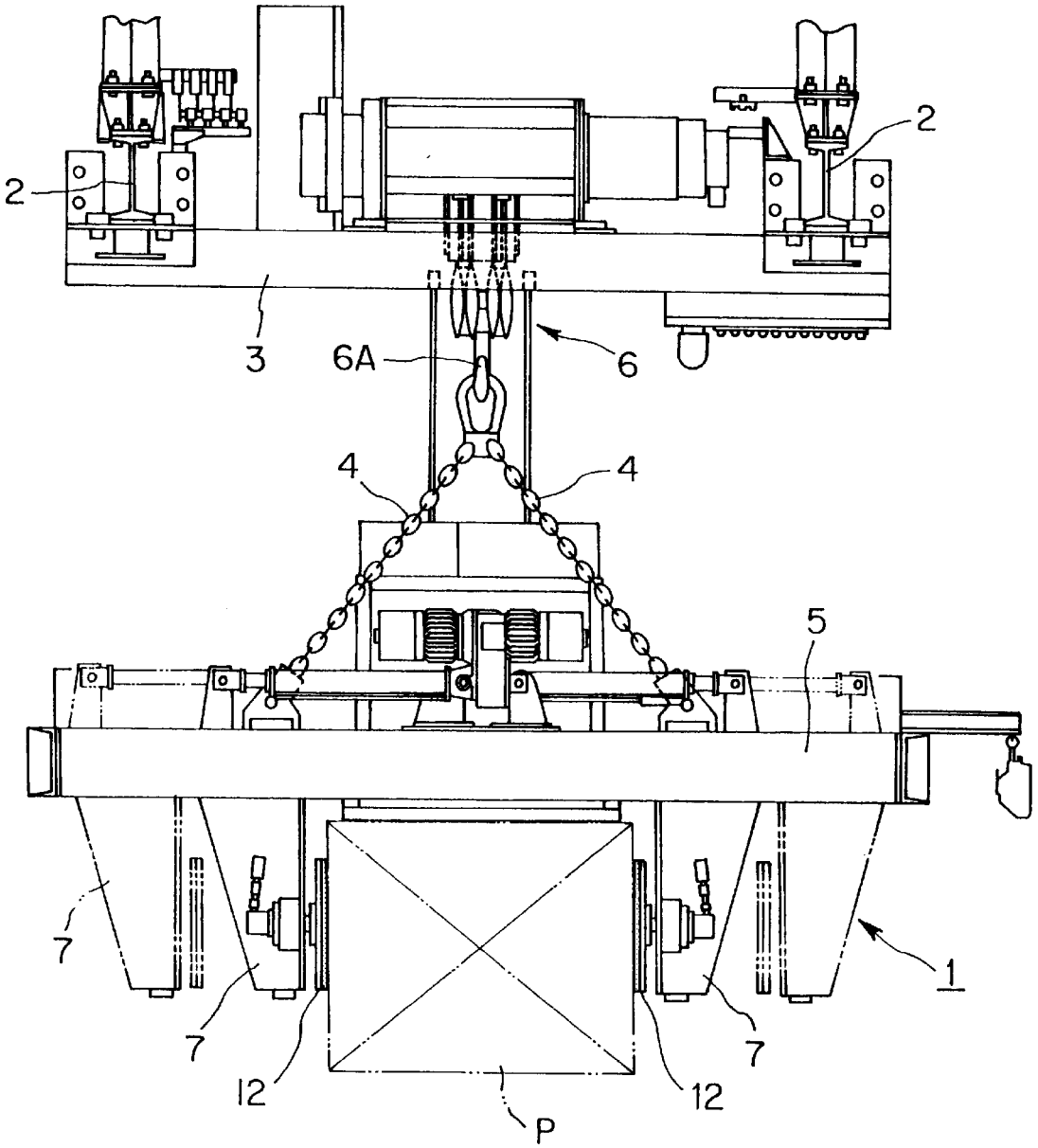
FIG. 1 is a front view showing one embodiment of an article gripping apparatus according to the present invention.

1. Article gripping apparatus
2. Travel rail
3. Travel frame
4. Chain
5. Elevating frame
6. Hoist
7. Clamp arm
8. Guide

9. Receiving sleeve
10. Linear working machine (opening- and closing driving means)
10A. Operating rod
11. Motor
12. Clamp body
13. Hydraulic jack
14. Plunger
15. Oil
16. Seal ring
17. Flow hole
18. Base
19, 20 Connecting member
21. Pressure switch (pressure detection means)
22. Compression spring

DESCRIPTION OF THE PREFERRED EMBODIMENTS

Figure 2:
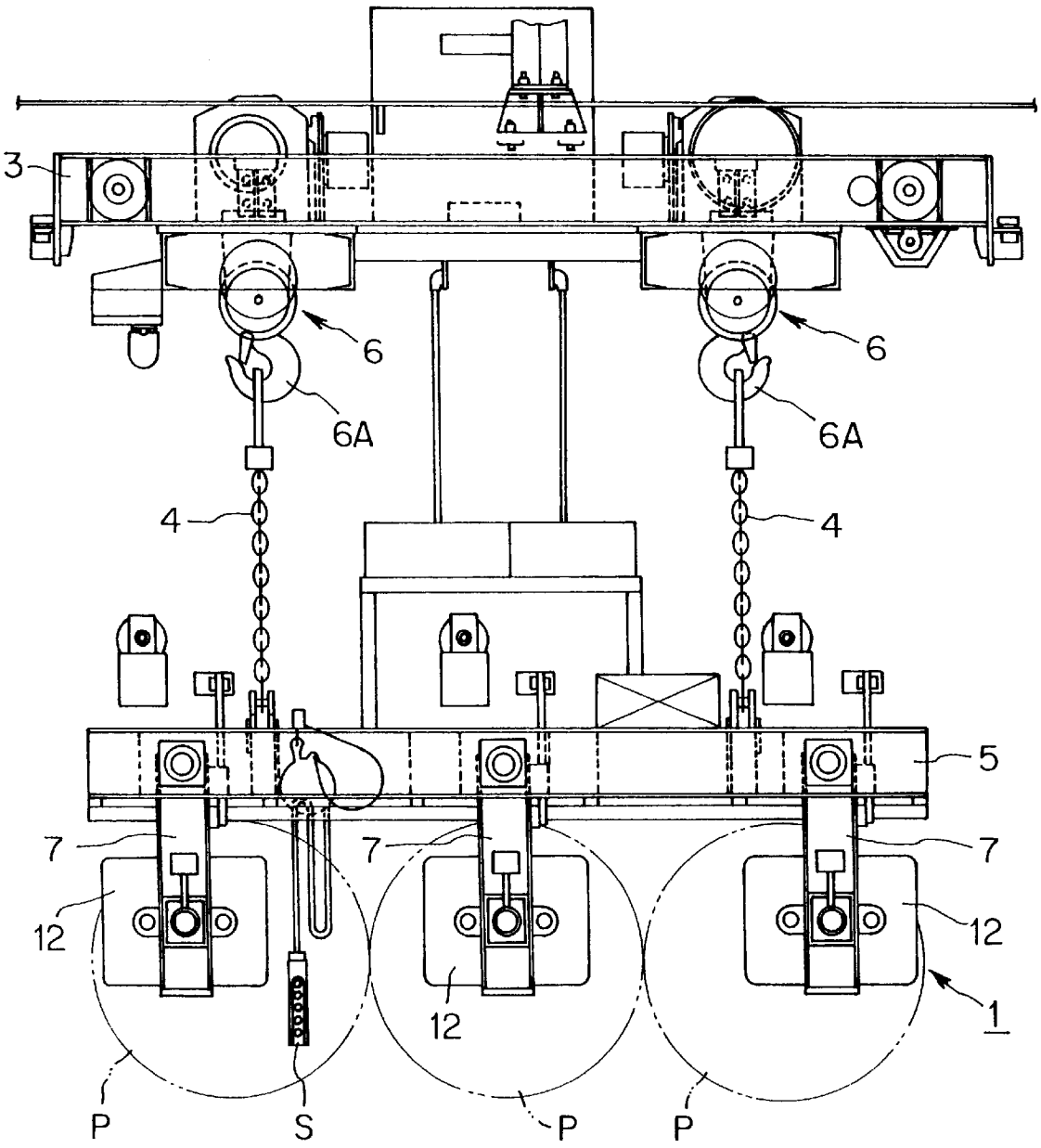
FIG. 2 is a side view showing one embodiment of an article gripping apparatus according to the present invention.
Figure 3:
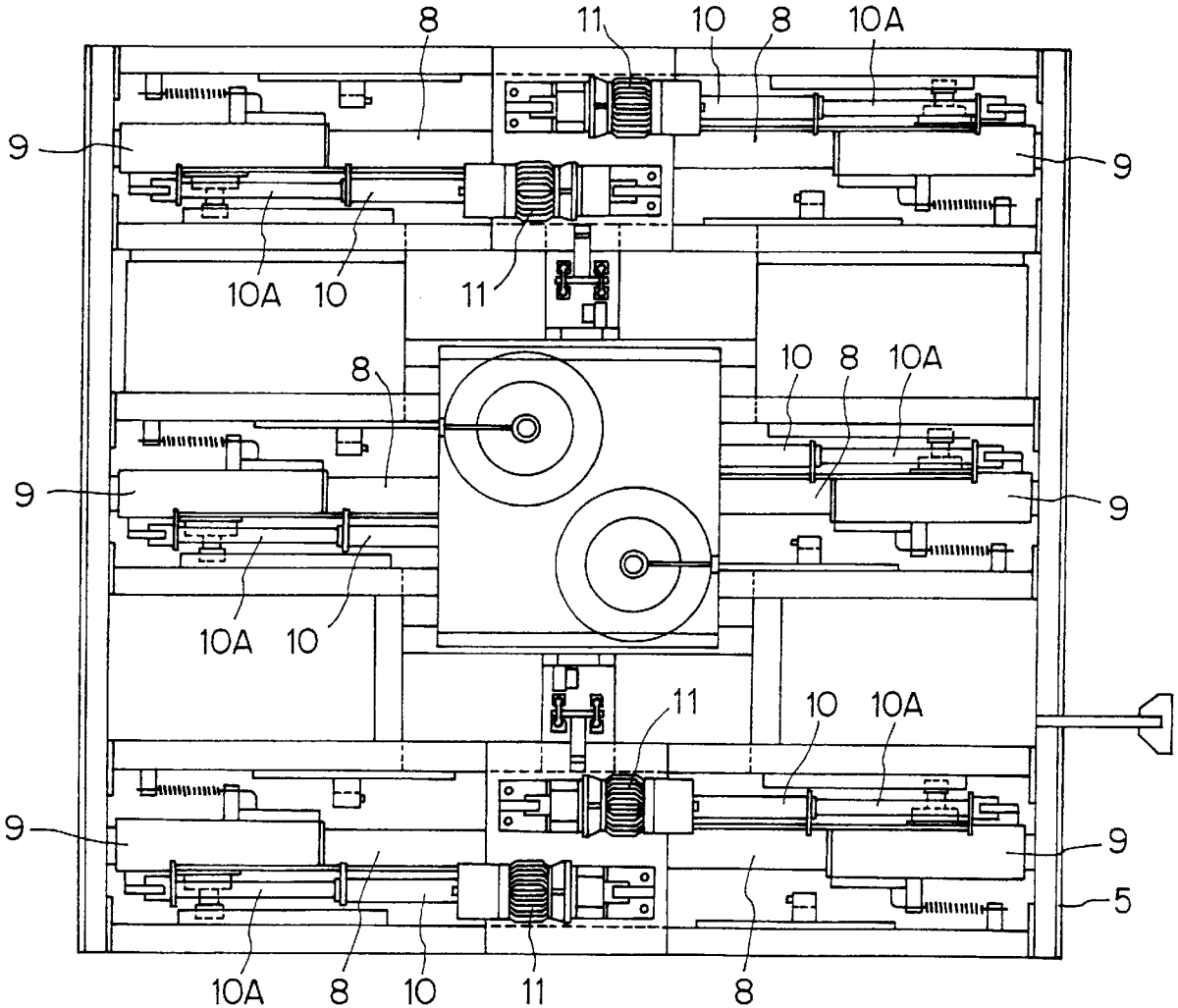
FIG. 3 is a plan view of an elevating frame as viewed from top showing one embodiment of an article gripping apparatus according to the present invention.

A first embodiment of the present invention will be explained with reference to the drawings. FIG. 1 is a front view showing the first embodiment of an article gripping apparatus according to the present invention, FIG. 2 is a side view, and FIG. 3 is a plan view. The article gripping apparatus 1 shown in these drawings is used to transfer the winding sheets for newspaper, and is provided on an elevating frame 5 suspended by a plurality of chains 4 from a travel frame 3 supported on and driven by a pair of left and right travel rails 2, 2 mounted on the ceiling of a building.

The chain 4 is connected to a hanging hook 6A of a hoist 6 mounted on the travel frame 3, and the elevating frame 5 is moved up and down by the hoist 6.

The elevating frame 5 is formed from a rectangular frame body as shown in FIG. 3, and is provided on the lower surface side thereof with three pairs of clamp arms 7 which can be opened or closed orthogonal to the travel direction of the travel frame 3.

Figure 4:
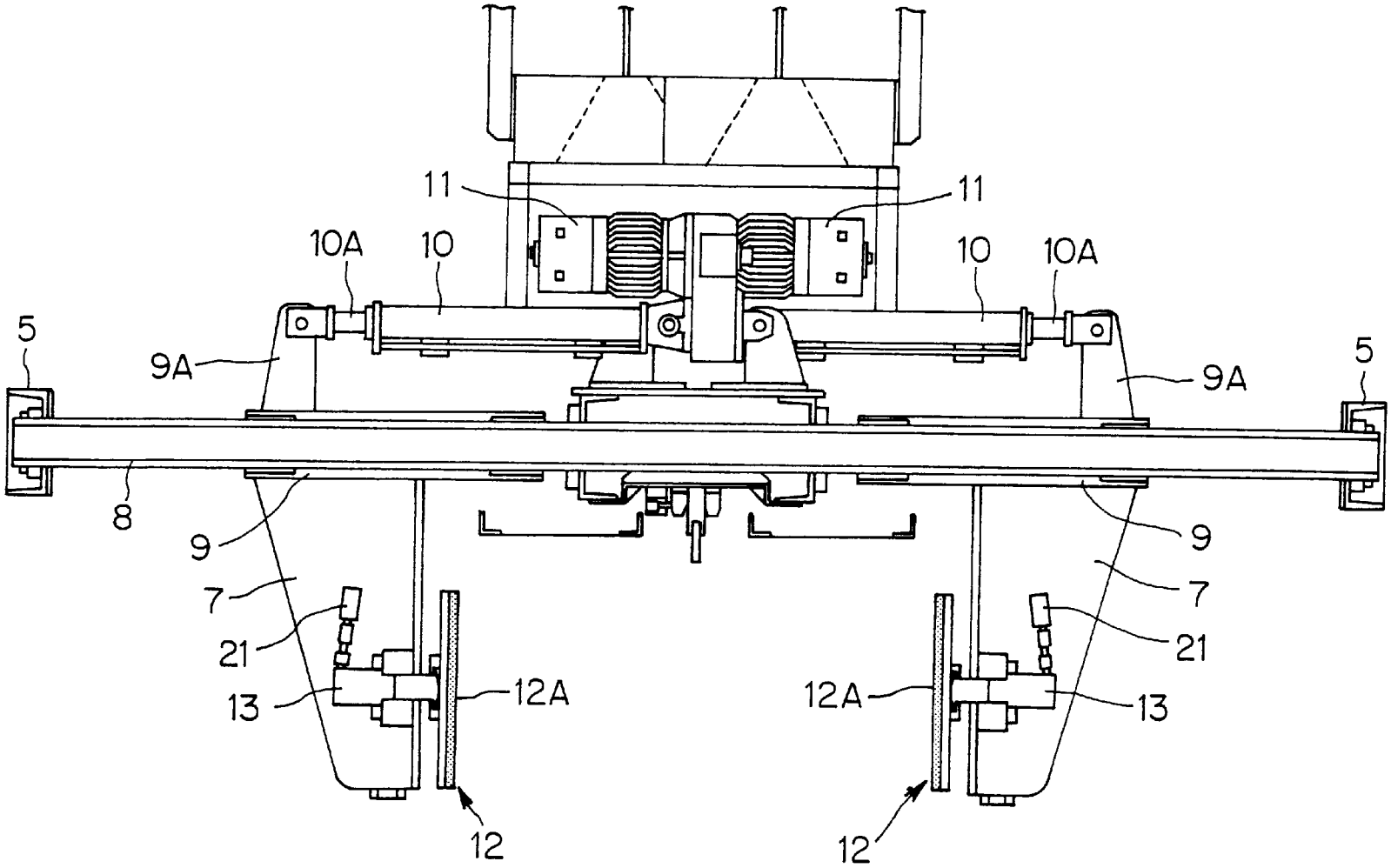
FIG. 4 is a view showing an opening- and closing mechanism for clamp arms in one embodiment of an article gripping apparatus according to the present invention.

FIG. 4 is a vise showing an opening and closing mechanism of a pair of clamp arm 7 out of the three pairs of clamp arms 7. In the clamp arm 7, a receiving sleeve 9 integral with the clamp arm 7 is slidably fitted externally of and supported on a horizontal pipe-like guide 8 both ends of which are supported on the elevating frame 5.

A connecting arm 9A is stood upright on the upper surface of the receiving sleeve 9, and the upper end of the connecting arm 9A is connected to the extreme end of an operating rod 10A of a linear working machine 10.

The linear working machine 10 is at its proximal end supported on the elevating frame 5 side, and formed from a ball thread mechanism driven by a motor 11, and the operating rod 10A is expanded and contracted by normal or reverse rotation of the motor Six sets (in all) of these linear working machines 10 and motors 11 are provided in order to individually open and close the six clamp arms 7, the respective motors 11 capable of being independently controlled to be driven and stopped.

As shown in FIG. 3. the sets of linear working machines 10 and motors 11 for driving the pair of opposed clamp arms 7 are arranged each other deviated on both sides of the guide 8 whereby the left and right widths of the elevating frame 5 can be narrowed, and the space for moving the elevating frame 5 can be reduced.

A clamp body 12 for coming in contact with both ends of the winding sheet P to grip the same as shown in FIGS. 1 and 2 is provided on the side opposed to the clamp arm 7. The clamp body 12 is connected to the clamp body 12 through a hydraulic jack 13 mounted on the clamp arm 7.

Figure 5:
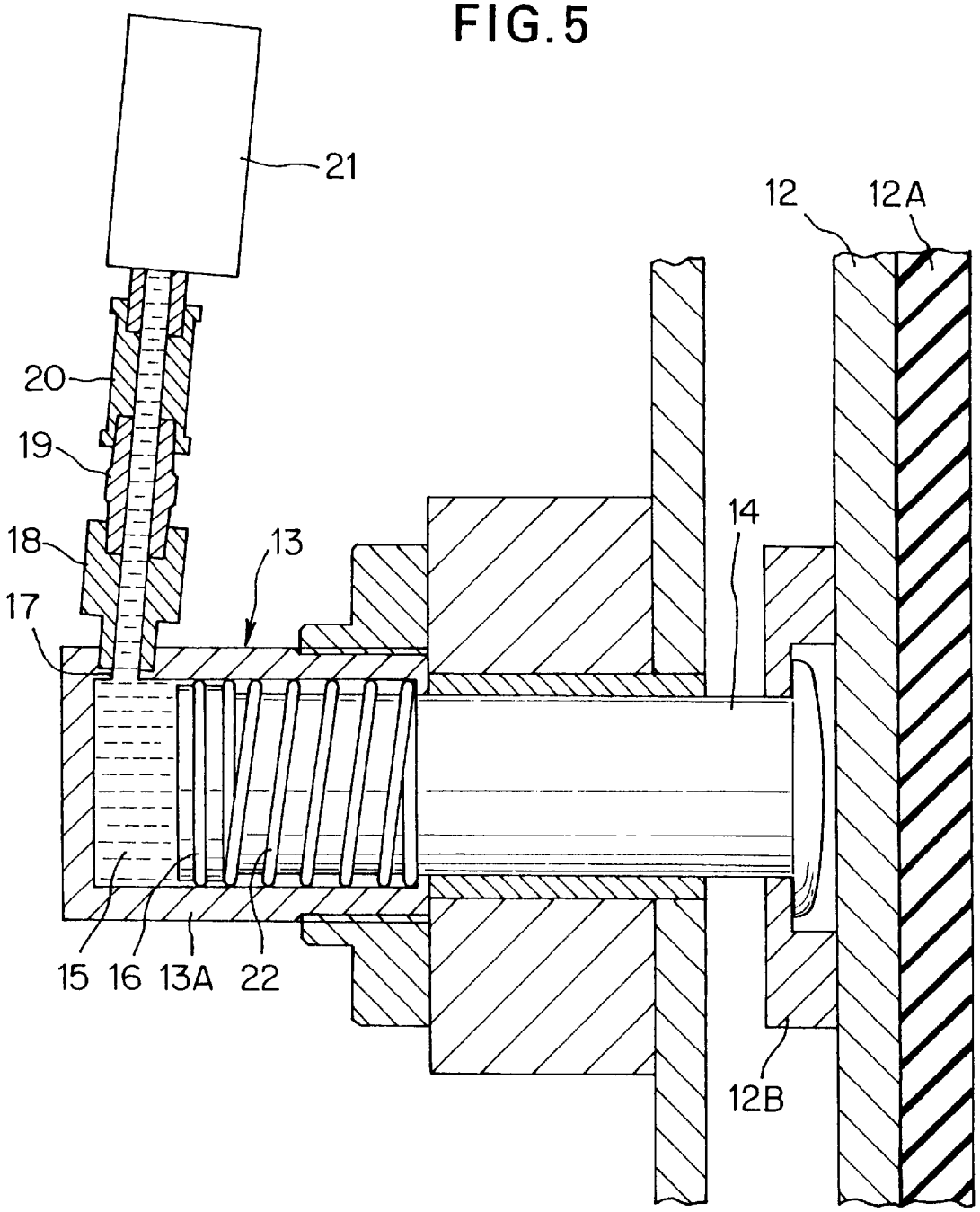
FIG. 5 is a sectional view of a hydraulic jack in one embodiment of an article gripping apparatus according to the present invention.
Figure 6:
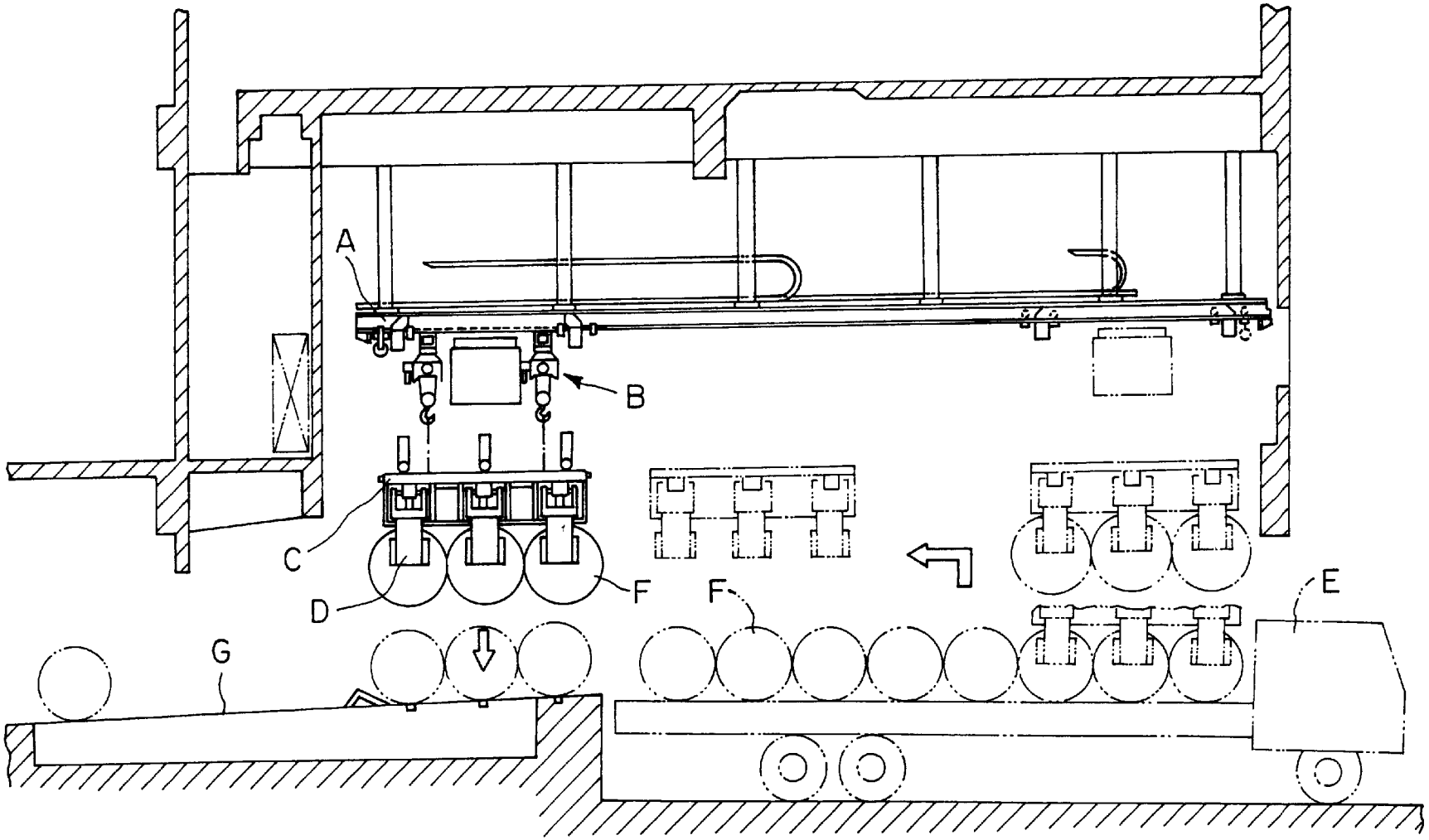
FIG. 6 (Prior Art)
FIG. 6 is a side view showing one example of the conventional article gripping apparatus.

The hydraulic jack 13 used is a hydraulic jack available from a market. As shown in FIG. 5, the clamp body 12 is connected to the extreme end of a plunger 14. The extreme end surface of the plunger 14 is formed into a slight spherical surface, and an extreme end peripheral edge thereof projects radially in the form of a collar to engage a holding portion 12B provided on the back of a connecting body 12 whereby the clamp body 12 tiltably connected to the plunger 14.

The proximal end of the plunger 14 is slidably inserted into a cylinder chamber 13A of the hydraulic jack 13. In the present embodiment, oil 15 is sealed into the cylinder chamber 13A, and a seal ring 16 mounted on the plunger 14 is provided between the outer peripheral surface of the plunger 14 and the inner peripheral surface of the cylinder chamber 13A to prevent oil 15 from leaking outside.

A flow hole 17 for flowing oil in and out of the cylinder chamber 13A from outside is opened in a position close to the bottom of the side wall of the cylinder chamber 13A.

Originally, the flow hole 17 is provided, in the case where the hydraulic jack 13 is used to raise the heavy article, for the purpose of supplying pressure oil into the cylinder chamber 13A to push up the plunger 14 supporting the heavy article. In the present invention, however, in the state in which oil 15 is sealed into the cylinder chamber 13A, a pressure switch 21 as pressure detection means is connected to a base 18 in communication with the flow hole 17 through connecting members 19, 20.

Further, a compression spring 22 is provided internally of the cylinder chamber 13A to bias the plunger 14 in a direction of pulling in the cylinder chamber 13A. The end of the plunger 14 within the cylinder chamber 13A always presses oil 15 by the biasing force of the compression spring 22 to prevent foams from mixing into the oil 15 within the cylinder chamber 13A to obstruct the operation of the pressure switch 21.

In this embodiment, the pressure switch 21 is so set as to output a detection signal when pressure of the oil 15 within the cylinder chamber 13A reaches 60 kg/cm$^2$, and when the detection signal is output, the motor 11 for driving the clamp arm 7 on which the hydraulic jack 13 is provided is stopped.

Accordingly, in the case where when the clamp arm 7 carries out the gripping operation, the detection signal is generated from the pressure switch 21, the movement of the clamp arm 7 stops. However, when the clamp arm 7 is actually stopped by the inertia of the linear working machine 10, the pressure in the cylinder chamber 13A rises about 50% from a set pressure of the pressure switch 21 to about 90 kg/cm$^2$.

Further, the pressure switch 21 is constituted so that when the pressure in the cylinder chamber 13A lowers to 60 kg/cm$^2$ or less, or exceeds 100 kg/cm$^2$, a detection signal is output to stop the operation of the entire apparatus including the travel operation of the travel frame 3 and the elevating operation of the elevating frame 5.

The description will be made of the case where a plurality of winding sheets for newspaper placed on the pallet of a truck not shown to the article removing floor of the sheet storage yard are transferred by the article gripping apparatus 1 constructed as described above. As shown in FIGS. 1 and 2, the travel frame 3 is travelled to the upper position of the pallet of the truck along the pair of left and right rails 2, 2 mounted on the ceiling of the building, and the hoist 6 is driven to move down the elevating frame 5 toward the pallet of the truck.

The chains 4 are connected to the hanging hooks 6A of the hoist 6 mounted on the travel frame 3, and the elevating frame 5 is driven to be moved up and down by the hoist 6.

On the lower surface of the elevating frame 5, there are provided winding paper detection sensors (not shown) corresponding to positions of each pair of clamp arms 7. When the winding sheet detection sensor detects the upper end of the winding sheet, the hoist 6 is stopped so that the clamp bodies 12 of the clamp arms 7 are located opposite to the ends of both sides of the winding sheet on the pallet.

The article gripping apparatus 1 in the present embodiment has three pairs of clamp arms 7 capable of simultaneously gripping three winding sheets P on the maximum. Therefore, in the case where heights of the winding sheets adjacent to each other placed on the pallet of the truck are different from each other, timings at which two hoists 6 stop are differentiated due to the difference in detection positions of the winding sheet detection sensors so that the elevating frame 5 can be stopped to be inclined along the arrangement of the winding sheets. It is possible to properly properly locate the clamp bodies 12 of the clamp arms 7 with respect to both ends of the plurality of winding sheets to be transferred.

After the clamp bodies 12 of the clamp arms 7 have been located with respect to the both ends of the winding sheets to be transferred as described above, the motors 11 for opening and closing the clamp arms 7 are driven all at once so that the pair of clamp arms 7 are moved in the access direction through the linear working machine 10 whereby the winding sheet P is gripped between the pair of clamp bodies 12 as shown in FIG. 1.

When the clamp body 12 is pressed against the end of the winding sheet P, the plunger 14 of the hydraulic jack 13 shown in FIG. 5 is pressed due to the reaction thereof, and the pressure of the oil 15 in the cylinder chamber 13A rises.

When the pressure reaches 60 kg/cm$^2$ as previously mention switch 21 is actuated, and the corresponding motor 11 is stopped by the detection signal thereof to stop the movement of the clamp arm 7.

In the case where three winding sheets P are gripped simultaneously as shown in FIG. 2, the pressure switch 21 is actuated every clamp arm 7 to stop and control the motor 11. Therefore, all the three winding sheets P are gripped with the proper gripping force.

After all the motors 11 have been stopped, the elevating frame 5 is moved up toward the travel frame 3 by the hoists 6 before and behind, and the elevating frame 5 stops in a horizontal state at the upper limit position.

Then, the travel frame 3 moves to and stops at the article removing floor of the sheet storage yard (not shown), and the hoist 6 is driven and the elevating frame 5 moves down. The article removing floor is provided with take-floor detection sensors for detecting the take-floor of the winding sheet P gripped by the pair of clamp arms 7. The stop position of two hoists 6 is controlled by the detection signal of these take-floor detection sensors. The elevating frame 5 is inclined along the inclination of the article removing floor and stops at the down position. After all the winding sheets P have reached the article removing floor, all the motors 11 on the elevating frame 5 are driven in the direction for opening the clamp arms 7, and the winding sheets P are opened onto the article removing floor.

In the case where in the midst when the winding sheets are transferred from the pallet of the truck to the article removing floor, the gripping pressure of the clamp arms 7 abnormally increases or decreases for some cause, the variation of oil pressure generated in the hydraulic jack 13 provided every clamp arm 7 is detected by the pressure switch 21 to output an abnormality detection signal, and the operation of all the apparatus is stopped by the abnormality detection signal.

As already described, in the present embodiment, the pressure switch 21 outputs the abnormality detection signal when the pressure within the cylinder chamber 13A lowers to 60 kg/cm$^2$ or exceeds 100 kg/cm$^2$, but the values of these pressures may be set to the optimum value depending on the weight or size of the winding sheets P to be handled.

Further, in the present embodiment, a series of transfer operations of the article gripping apparatus 1 are automatically carried out by feeding signals from the pressure switch 21 or other sensors to control devices not shown. However, in the case where the abnormality detection signal is output to stop the entire apparatus, an operator operates a pendant switch S suspended from the elevating frame 5 whereby the travel frame 3 is moved to a safe place and the elevating frame 5 is moved down to release the winding sheets P from the clamp arms 7.

While in the above-described embodiment, an example is shown in which the article gripping apparatus is used to transfer the winding sheets for newspaper, the embodiment is not limited thereto but this can be similarly applied to articles capable of being gripped between the clamp bodies of the clamp arms. Further, as the hydraulic jack for operating the pressure switch, there can be used a hydraulic jack in which water or other liquids are sealed in.

While in the above-described embodiment, the linear working machine formed from a ball thread mechanism driven by the motor is used as the opening- and closing driving means for individually opening- and closing moving the clamp arms, the aforesaid means is not limited thereto but for example, an opening- and closing driving means such as a hydraulic cylinder may be used as long as it can positively control the driving and stopping.

Further, in the article gripping apparatus according to the present invention, one pair of clamp arms or more, that is, the number of clamp arms according to uses can be provided. Further, the apparatus can be mounted on an arm crane or on the extreme end of an arm of a robot for use with transfer or transportation of grippable articles.

EFFECT OF THE INVENTION

As mentioned above, according to the present invention, the hydraulic jack is intervened between the clamp body and the clamp arm for gripping the article so that when the article is gripped, the clamp body converts the gripping pressure acting on the article into the liquid pressure by the hydraulic jack to transmit it to the pressure switch whereby the rise of the liquid pressure to a level in excess of a predetermined pressure is detected by the pressure switch to stop the opening- and closing driving means of the clamp arms. Therefore, the rise of the gripping pressure received by the article from the individual clamp body can be sensitively detected, and the article can be gripped with the proper gripping pressure.

Moreover, since the rise of the gripping pressure of the article is detected by a combination of the hydraulic jack such as the existing hydraulic jack available from a market, the construction is simple, the high reliability is obtained, and the manufacturing cost of the article gripping apparatus can be reduced.

Further, in the case of the constitution in which when the pressure in the hydraulic jack is outside the predetermined range in the state in which the article is gripped between the opposed clamp bodies of the pair of clamps, the pressure switch outputs the abnormality detection signal, by the abnormality detection signal, the alarm is issued to notify an operator of abnormality or stop the operation of the entire apparatus, thus preventing the article from being damaged or fallen and improving the safety.

What is claimed is:

1. An article gripping apparatus comprising:

a plurality of opening and closing driving means for individually opening and closing moving clamp arms;

a hydraulic jack provided on each of said arms and having a plunger projected on the opposite side, said plunger being prevented from backward movement by liquid sealed in said hydraulic jack;

a pair of clamp bodies provided at the extreme end of the plunger of each hydraulic jack to grip an article from both sides; and a plurality of pressure detection means for individually outputting a detection signal when the liquid pressure in the hydraulic jack rises to a level in excess of a predetermined pressure, characterized in that each of said opening and closing driving means is operative in response to said detection signal output from said pressure detection means associated with said corresponding clamp arm, to stop forward movement of said clamp arm when the article is gripped between said pair of clamp bodies.

2. The article gripping apparatus according to claim 1, wherein said pressure detection means further outputs an abnormal detection signal when the pressure in one of said hydraulic jacks is outside a predetermined range in the state in which said article is gripped between said opposed clamp bodies of said pair of clamps.

3. An article gripping apparatus comprising:

a first moveable clamp arm and a second movable clamp arm;

a first hydraulic jack and a second hydraulic jack, said first and second hydraulic jacks mounted on said first and second clamp arms respectively;

a first plunger and a second plunger;

a first clamp body and a second clamp body;

said first plunger having said first clamp body and giving a certain pressure to said first hydraulic jack;

said second plunger having said second clamp body and giving a certain pressure to said second hydraulic jack;

said first and second plungers being prevented from backward movement by liquid sealed therein;

a first pressure sensor which monitors the pressure in the first hydraulic jack;

a second pressure sensor which monitors the pressure in the second hydraulic jack; and, said first and said second pressure sensors act permissively and/or prohibitively with respect to movement of said first and second clamp arms to prevent damage to and/or dropping of the article.

* * * * *